US006880306B2

(12) United States Patent
Burken et al.

(10) Patent No.: US 6,880,306 B2
(45) Date of Patent: Apr. 19, 2005

(54) BRACKET SYSTEM FOR MOUNTING FIBERGLASS PANEL TILES

(75) Inventors: David J. Burken, Blue Grass, IA (US); James C. Fitzgerald, Cedar Rapids, IA (US); William J. McKibbin, Wilton, IA (US); Christian J. Kleppe, Muscatine, IA (US); Robert Nichols, Muscatine, IA (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/355,912

(22) Filed: Jan. 29, 2003

(65) Prior Publication Data

US 2004/0144049 A1 Jul. 29, 2004

(51) Int. Cl.[7] ..... E04B 2/30

(52) U.S. Cl. ..... 52/483.1; 52/489.1; 52/489.2; 52/712; 52/715; 52/764; 52/765

(58) Field of Search ..... 52/483.1, 489.1, 52/489.2, 712, 715, 764, 765

(56) References Cited

U.S. PATENT DOCUMENTS

| | | | | | |
|---|---|---|---|---|---|
| 1,280,173 | A | * | 10/1918 | Culter | 52/712 |
| 1,974,819 | A | * | 9/1934 | Koerner | 52/765 |
| 2,258,574 | A | * | 10/1941 | Leary | 52/362 |
| 2,368,620 | A | * | 2/1945 | Strom | 52/242 |
| 3,308,590 | A | * | 3/1967 | Ettore et al. | 52/281 |
| 4,245,448 | A | | 1/1981 | Agar | |
| 4,281,494 | A | * | 8/1981 | Weinar | 52/489.2 |
| 4,333,286 | A | | 6/1982 | Weinar | |
| 4,377,060 | A | | 3/1983 | Ragland | |
| 4,448,007 | A | | 5/1984 | Adams | |
| 4,467,578 | A | | 8/1984 | Weinar | |
| 4,467,579 | A | | 8/1984 | Weinar | |
| 4,471,593 | A | | 9/1984 | Ragland | |
| 4,498,272 | A | * | 2/1985 | Adams | 52/714 |
| 4,621,473 | A | * | 11/1986 | Wendt | 52/489.2 |
| 4,637,195 | A | * | 1/1987 | Davis | 52/693 |
| 4,719,730 | A | | 1/1988 | Winkowski | |
| 4,866,904 | A | * | 9/1989 | Paul | 52/715 |
| 4,995,215 | A | | 2/1991 | Menchetti | |
| 5,058,354 | A | | 10/1991 | Menchetti | |
| 5,058,355 | A | | 10/1991 | Menchetti | |
| 5,107,651 | A | | 4/1992 | Menchetti | |
| 5,152,117 | A | * | 10/1992 | Wynar | 52/712 |
| 5,185,197 | A | * | 2/1993 | Nixon | 428/196 |
| 5,408,796 | A | * | 4/1995 | Hashimoto et al. | 52/489.2 |
| 5,410,854 | A | * | 5/1995 | Kimmell et al. | 52/712 |
| 5,590,502 | A | * | 1/1997 | Wendt | 52/489.2 |
| 5,966,893 | A | * | 10/1999 | Quillin | 52/713 |

* cited by examiner

*Primary Examiner*—Carl D. Friedman
*Assistant Examiner*—Nahid Amiri
(74) *Attorney, Agent, or Firm*—Joseph H. Golant; Jones Day

(57) ABSTRACT

A tile bracket support system that has a tile side support bracket or clip and a tile bottom support bracket or clip attached to the tile without the use of screws or adhesives. The tile side support bracket or clip has tile side edge embedding members and vertical frame member engaging members. The tile bottom support bracket has tile bottom edge embedding members and horizontal frame member engaging members thereby holding the tile affixed to the horizontal and vertical frame members without the use of screws or adhesives.

14 Claims, 2 Drawing Sheets

BRACKET SYSTEM FOR MOUNTING FIBERGLASS PANEL TILES

CROSS REFERENCE TO PRIORITY APPLICATION

This application is a continuation in part of application Ser. No. 10/160,602 entitled "Simplified Wall Panel" filed May 31, 2002, now U.S. Pat. No. 6,775,953.

BACKGROUND OF THE INVENTION

1. Field of the Invention

The present invention relates in general to brackets for mounting tile such as wall tile, to vertical and horizontal frame members and in particular to a bracket system having projections that can be embedded in the side and bottom edges of a tile for attachment to the tile without the use of screws, adhesives, or other mechanical fastening devices. The brackets, or clips, have projections thereon that enable them, and the tile to which they are affixed, to be attached to vertical and horizontal frame members.

2. Description of the Related Art

There are a multitude of various brackets for attaching wall tile to frame members. Most of these brackets use screws, adhesives, or other mechanical fastening devices to attach the bracket to the wall tile. Such representative brackets are illustrated in U.S. Pat. Nos. 4,245,448; 4,281,494; 4,333,286; 4,377,060; 4,448,007; 4,467,578; 4,467,579; 4,471,593; 4,719,730; 4,866,904; 4,995,215; 5,058,354; 5,058,355; 5,107,651; 5,408,796; and 5,590,502.

In an effort to provide "steel free" tile that performed as good or better than the existing tiles in terms of fire rating and sound rating, it was found that fiberglass met all the design criteria. However, the fiberglass material does not have the same mechanical properties as most other substrates due to the glass strands forming the composition of the material. Thus, using screws, adhesives with low adhesion, or other mechanical fastening devices will not properly and securely attach the mounting brackets to the tile.

The present invention provides side edge and bottom edge mounting brackets that mount tile on horizontal and vertical frame supports and does not require the use of hot melt adhesives, screws, or other mechanical devices to fasten them to the tile and that perform the function of supporting the tile.

SUMMARY OF THE INVENTION

The present invention is for a bracket system for mounting panel tiles and especially fiberglass panel tiles and comprises a tile side edge support bracket and a tile bottom edge support that attaches the tile to vertical and horizontal frame members while they are uniquely attached to the tile itself without the use of screws, adhesives, or other mechanical support devices.

The side edge support bracket is constructed of thin gauge spring steel having a thickness sufficient to keep the memory of its shape under normal conditions of use and allowing the bracket not to telegraph three fabric on the like.

The side edge support bracket has a flat portion for resting against the tile and a first end for embedding engagement with the tile and a second end for resting on and penetrating the tile side edge. A vertical frame member engaging device, well known in the art comprises an attachment clip that is attached to the side edge support bracket by means of several openings and abutment projections formed on the side edge support bracket and on the attachment clip.

The bottom edge support bracket has a substantially flat plate with a first prong extending from a first end for embedding into the tile and a first tab extending perpendicularly from a second end with a second prong that penetrates the bottom edge of the tile. A second tab extends substantially perpendicular to the flat plate opposite the first tab for engaging a horizontal frame member to support the tile on the horizontal frame member.

Thus, the invention relates to side edge brackets and to bottom edge brackets that are fastened to a tile without the use of screws, adhesives, or other mechanical devices that support the tile on vertical and horizontal frame members.

The invention also relates to side edge and bottom edge tile brackets that are fastened to "steel free" tiles without the use of screws, adhesives, or other mechanical fasteners.

Thus, the present invention relates to a tile bracket support system comprising a tile side support bracket having tile side edge embedding members and vertical frame member engaging elements; and a tile bottom support bracket having tile bottom edge embedding members and horizontal frame member engaging elements thereby holding the tile affixed to the horizontal and vertical frame members without the use of screws and adhesives.

BRIEF DESCRIPTION OF THE DRAWINGS

These and other objects of the present invention will be more fully disclosed when taken in conjunction with the following detailed description of the drawings in which like numerals represent like elements, and in which.

DETAILED DESCRIPTION OF THE DRAWINGS

Figure 1:
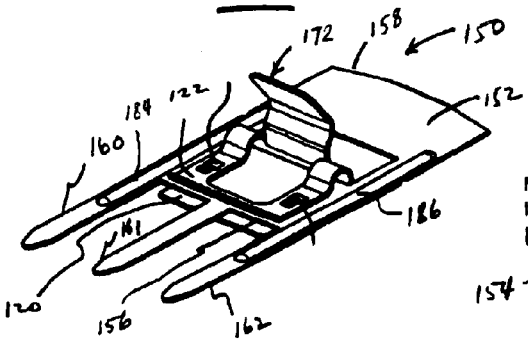
FIG. 1 is a front top isometric view of a tile side edge support bracket and attachment clip.

In FIG. 1, an inventive tile side support bracket 150 is shown in more detail. It has a substantial flat portion 152 that rests against a tile 154 (partially shown in broken line in FIG. 2) when the support bracket 150 is attached thereto. The flat portion 152 has a first end 156 and a second end 158. At least one prong 160 (along with two others 161, 162) extends longitudinally from the first end 156 of the support bracket 150 for embedding engagement with the tile 154 in a well-known manner.

Figure 2:
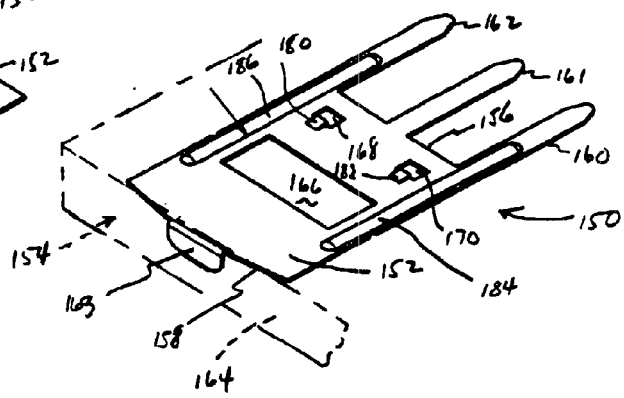
FIG. 2 is a rear bottom isometric view of the tile side edge support bracket shown in FIG. 1.
Figure 3:
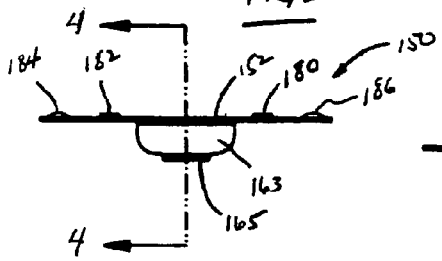
FIG. 3 is a front elevation view of the tile side edge support bracket shown in FIGS. 1 and 2.
Figure 4:
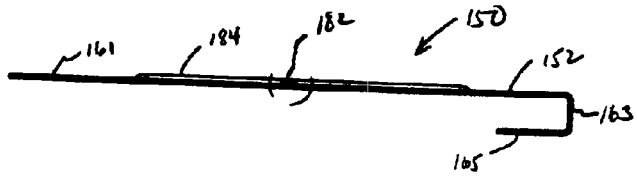
FIG. 4 is a sectional elevation view taken through line 4—4 of FIG. 3.
Figure 5:
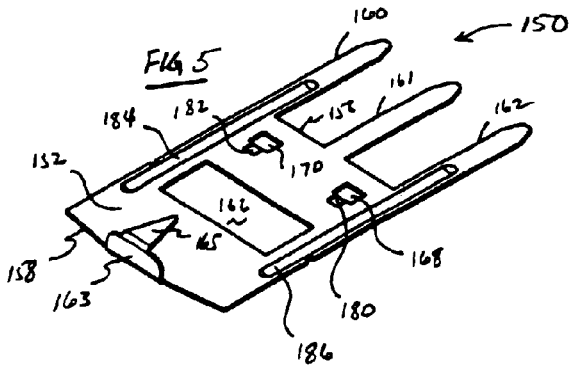
FIG. 5 is a rear bottom isometric view of the tile side edge support bracket shown in FIGS. 1–4.
Figure 6:
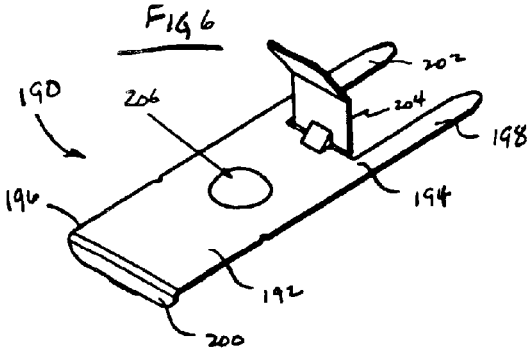
FIG. 6 is a front top isometric view of a tile bottom edge support bracket.
Figure 7:
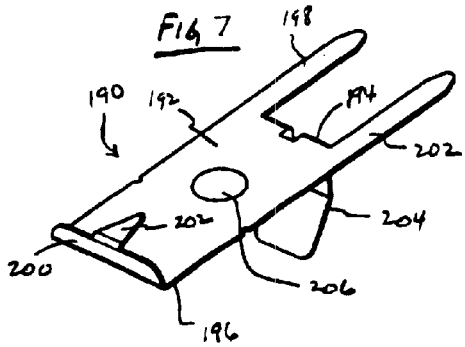
FIG. 7 is a front bottom isometric view of the tile bottom edge support bracket shown in FIG. 6.
Figure 8:
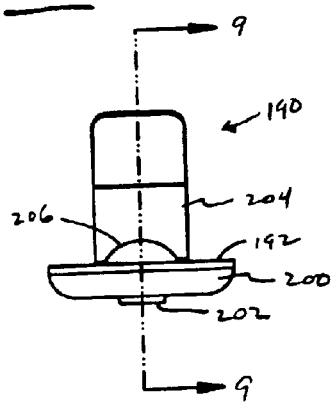
FIG. 8 is a front elevation view of the tile bottom edge support bracket shown in FIGS. 6 and 7.

An integrally formed tab 163, shown in FIG. 2 and FIG. 5, extends outwardly from the second end 158 of the flat portion 152 of the support bracket 150 substantially perpendicular to the flat portion 152 for engaging a side edge 164 of the tile 154. A sharp projection or tile side edge penetrating element 165 (FIG. 5) extends substantially perpendicular to the underlying tab 163 in the direction of the first end 156 of the support bracket 150 for embedding in the side edge of the tile 154 as shown.

A large opening 166 and two small openings 168, 170 are formed in the flat portion 152 between the first and second ends 156 and 158 of the support bracket 150 for receiving an attachment clip 172 that engages a vertical frame member (not shown) to attach the tile to the vertical frame member in a well-known manner.

The novel side support bracket 150 it is constructed of thin gauge spring steel. The thin gauge is of sufficient thickness to allow the side underlying support bracket 150 to keep the memory of its shape under normal conditions while allowing the support bracket 150 not to telegraph through the fabric.

The at least one prong 160 (shown as three prongs in FIGS. 1 and 2) is able to dig down and embed itself into the tile fiberglass. The penetrating element 165 that is located on the bottom of the bracket 150 (FIG. 5) functions in the same manner and embeds itself in the side edge of the tile. This penetrating element 165 keeps the bracket 150 from being able to pull out of the fiberglass when force is applied thereto. It also locates where the attachment clip 172 (for attachment to a vertical frame support) is to be placed. The bracket 150 has the large opening 166 and two small openings 168, 170 in the flat portion 152 between the first and second ends 156 and 158 that, as stated earlier, receives the attachment clip 172 that is used to engage the vertical frame support member. One leg of the attachment clip 172 extends through the opening 166 in a well-known manner and is anchored there by detents 180 and 182 on the bracket 150 and on the attachment clip. Since the attachment clip 172 is spring-loaded around the openings 166, 168, 170 and the abutting detents 180, 182, the attachment clip is solidly anchored to the side support bracket 150.

The side bracket 150 also has two elongated stiffening ribs 184 and 186 on opposite sides of the flat portion 152 of the side edge support bracket 150 in a longitudinal direction as shown to keep the flat portion 152 from bowing in an accurate manner when force is applied thereto.

Thus, as stated, the side edge support bracket 150 attaches the tiles to vertical frame support elements that are well known in the art. To attach the tiles to a horizontal frame support element, a bottom edge bracket is used.

FIGS. 6–9 are top perspective, bottom perspective, front and cross-sectional views, respectively, of the bottom edge support bracket 190. The tile bottom edge support bracket 190 has a substantially flat plate area 192 with first and second ends 194 and 196 respectively. At least one first prong 198 of the two prongs extends longitudinally from the first end 194 of said flat plate area 192 for embedding into the tile surface in a well-known manner. A first tab 200 extends substantially perpendicular to the flat plate area 192 at the second end 196 for resting against the bottom edge of the tile in a well-known manner. A second prong 202 extends perpendicular to the first tab 200 in the direction of a first end 194 of the bracket 190 for penetrating the bottom edge 203 of the tile 154 (partially shown in broken line in FIG. 9) in a well-known manner. A second tab 204 is integrally formed with, and extends substantially perpendicular to, the flat plate area 192 in a direction opposite the first tab 200 for engaging the horizontal frame member 52 in a well-known manner and supporting the tile on the horizontal frame member.

Figure 9:
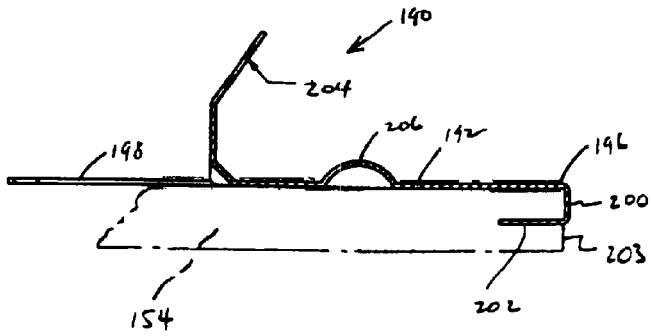
FIG. 9 is a sectional elevation view taken along line 9—9 of FIG. 8.

As can be seen in the cross-sectional view in FIG. 9, a raised area 206 is integrally formed in the plate area 192 of the bottom support bracket 190 between the first and second ends 194 and 196, respectively, and prevents the flat plate area 192 from bowing in an arcuate manner when attached to the tile and the horizontal frame member and force is applied thereto.

Thus, there has been disclosed a novel bracket system for mounting tiles to vertical and horizontal support members and wherein the brackets are attached to the tile without the use of screws or adhesives.

What is claimed is:

1. A bracket system for mounting steel-free tile, having a side edge and a bottom edge, to a frame having vertical and horizontal support members comprising:

at least one tile side edge support bracket comprising:

a substantially flat portion for resting against said tile, said flat portion having first and second ends;

at least one prong extending longitudinally from said first end of said flat portion for embedding engagement with said steel-free tile;

an integrally formed plate extending outwardly from said second end of said flat portion substantially perpendicular to said flat portion for engaging a side edge of said tile;

a tile side edge penetrating element extending substantially perpendicular to said integrally formed plate in the direction of said first end of said flat portion; and an opening in said flat portion between said first and said second ends for receiving an attachment that engages a vertical frame member to attach said tile to the vertical frame member; and at least one tile bottom support bracket comprising:

a substantially flat plate having first and second ends;

at least one first prong extending longitudinally from the first end of said flat plate for embedding engagement with said tile;

a first projection extending substantially perpendicular to said flat plate at said second end for resting against the bottom edge of said tile;

a second prong extending perpendicular to said projection in the direction of said first end of said flat plate for penetrating the bottom edge of said tile; and a second projection extending substantially perpendicular to said flat plate in a direction opposite to said first projection for engaging a horizontal frame member and supporting said tile on the horizontal frame member.

2. The bracket system of claim 1 further including:

first and second small openings spaced from said first mentioned opening in said flat portion for receiving said attachment clip.

3. The bracket system of claim 1 further including:

an elongated stiffening rib integrally formed in a longitudinal direction on each side of said flat portion of said side edge support bracket to keep the flat portion rigidly flat and prevent it from bowing in an arcuate manner.

4. The bracket system of claim 1 further comprising:

a raised area integrally formed in said flat plate of said bottom support bracket between said first and said second ends to prevent said flat plate from bowing in an arcuate manner when the bottom support clip is attached to said tile.

5. A tile bracket support system comprising:

a tile side support bracket having a first portion for embedding in a tile, said first portion having an opening for receiving an attachment clip for engaging a vertical frame member, a second portion for embedding in said tile, said second embedding portion being parallel to said first embedding portion, and a tab portion connecting said first and said second embedding portions; and a tile bottom support bracket having a first portion for embedding in said tile, a second portion for embedding in said tile, a first tab portion for connecting said first and said second embedding portions, and a second tab for engaging a horizontal frame member thereby holding said tile affixed to the horizontal and the vertical frame members without the use of screws or adhesives, said opening of said tile side support bracket including three openings, a large opening and two small openings, said two small openings being spaced from each other and from said large opening.

6. The system of claim 5 including:

a pair of detents formed in said first portion of said side support bracket adjacent said small openings for engaging said attachment clip.

7. The system of claim 6 wherein:

said first portion of said side support bracket includes a longitudinally extending rib.

8. A tile bracket system comprising:

a tile side support bracket having a first portion for embedding in a tile, said first portion having an opening for receiving an attachment clip for engaging a vertical frame member, a second portion for embedding in said tile, said second embedding portion being generally parallel to said first embedding portion, and a tab portion connecting said first and said second embedding portions; and a tile bottom support bracket having a first portion for embedding in said tile, a second portion for embedding in said tile, a first tab portion for connecting said first and said second embedding portions, and a second tab for engaging a horizontal frame member thereby holding said tile affixed to the horizontal and the vertical frame members without the use of screws or adhesives, said portion of said side support bracket including three longitudinally extending prongs, said three prongs extending from a front second of said first portion and said tab portion of said side support bracket being located at a rear of said first portion, and said opening of said tile side support bracket including three openings, a large opening and two small openings, said two small openings being spaced from each other and from said large opening.

9. The system of claim 8 including:

a pair of detents formed in said first portion of said side support bracket adjacent said small openings for engaging said attachment clip.

10. The system of claim 9 wherein:

said first portion of said side support bracket includes a longitudinally extending rib.

11. A tile bracket support system comprising:

a tile side support bracket having a first portion for embedding in a tile, said first portion having an opening for receiving an attachment clip for engaging a vertical frame member, a second portion for embedding in said tile, said second embedding portion being generally parallel to said first embedding portion, and a tab portion connecting said first and said second embedding portions; and a tile bottom support bracket having a first portion for embedding in said tile, a second portion for embedding in said tile, a first tab portion for connecting said first and said second embedding portions, and a second tab for engaging a horizontal frame member thereby holding said tile affixed to the horizontal and the vertical frame members without the use of screws or adhesives, said first portion of said bottom support bracket including a prong extending from a front section, said first tab portion extending from a rear section, said second tab portion extending from said front section of said first portion of said bottom support bracket in a perpendicular direction, said first tab portion extending parallel to said second tab portion and in an opposite direction, and said opening including three openings, a large opening and two small openings, said two small openings being spaced from each other and from said large opening.

12. The system of claim 11 including:

a pair of detents formed in said first portion of said side support bracket adjacent said small openings for engaging said attachment clip.

13. The system of claim 12 wherein:

three prongs extend from a front section of said first portion of said side support bracket; and said tab portion of said side support bracket is located at a rear section of said first portion of said side support bracket.

14. The system of claim 13 wherein:

said first portion of said side support bracket includes a longitudinally extending rib.

* * * * *